US010724311B2

(12) United States Patent
Parekh et al.

(10) Patent No.: US 10,724,311 B2
(45) Date of Patent: Jul. 28, 2020

(54) SYSTEM FOR SETTING A DOWNHOLE TOOL

(71) Applicants: Yash Parekh, Houston, TX (US); Barbara Pratt, Houston, TX (US)

(72) Inventors: Yash Parekh, Houston, TX (US); Barbara Pratt, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 30 days.

(21) Appl. No.: 16/021,516

(22) Filed: Jun. 28, 2018

(65) Prior Publication Data

US 2020/0003018 A1 Jan. 2, 2020

(51) Int. Cl.

| | |
|---|---|
| ***E21B 19/18*** | (2006.01) |
| ***E21B 23/08*** | (2006.01) |
| ***E21B 33/1295*** | (2006.01) |

(52) U.S. Cl.

CPC ..... *E21B 19/18* (2013.01); *E21B 23/08* (2013.01); *E21B 33/1295* (2013.01)

(58) Field of Classification Search

CPC ..... E21B 33/129

See application file for complete search history.

(56) References Cited

U.S. PATENT DOCUMENTS

| | | | | |
|---|---|---|---|---|
| 5,261,487 | A * | 11/1993 | McLeod | E21B 33/126 166/196 |
| 8,997,853 | B2 | 4/2015 | Vanlue | |
| 2008/0011489 | A1 | 1/2008 | McGuire et al. | |
| 2013/0186649 | A1 | 7/2013 | Xu et al. | |
| 2017/0260825 | A1 | 9/2017 | Schmidt et al. | |
| 2018/0051532 | A1 | 2/2018 | Smith et al. | |
| 2019/0112891 | A1* | 4/2019 | Kellner | E21B 33/129 |
| 2019/0203557 | A1* | 7/2019 | Dirocco | E21B 33/1208 |

OTHER PUBLICATIONS

International Search Report and Written Opinion for International Application No. PCT/US2019/038374; International filing Date Jun. 21, 2019; Report dated Oct. 8, 2019 (pp. 1-9).

* cited by examiner

*Primary Examiner* — David J Bagnell
*Assistant Examiner* — Dany E Akakpo
(74) *Attorney, Agent, or Firm* — Cantor Colburn LLP

(57) ABSTRACT

A downhole tool includes a tool member having a radially outer surface and a radially inner surface. The radially inner surface includes an angled section. A drive member is axially spaced from the tool member. The drive member includes a radially outer surface portion and a radially inner surface portion. The radially outer surface portion includes an angled portion. A seal element is provided on the drive member. The seal element includes a first portion coupled to the radially outer surface portion and a second portion that is radially outwardly disengagable from the radially outer surface portion in response to one of fluid pressure and fluid flow.

18 Claims, 4 Drawing Sheets

SYSTEM FOR SETTING A DOWNHOLE TOOL

BACKGROUND

In the resource exploration and recovery industry, boreholes are formed to test for and recover formation fluids. During testing and extraction, various tools are deployed into the borehole. A packer may be used to isolate one portion of a borehole from another. A frac plug may be used to initiate a fracture in a formation. Setting a packer, a frac plug, or other tools may require the use of drop balls, explosive charges or other tools that increase an overall cost and complexity of operation. Drop balls and ball seats often times require a time consuming and costly removal process. Further, if using explosive charges, transportation and handling costs may significantly increase operational expenses. Accordingly, the art would be receptive of alternative methods for setting tools that use mechanical and/or chemical tools.

SUMMARY

In accordance with an exemplary embodiment, a downhole tool includes a tool member having a radially outer surface and a radially inner surface. The radially inner surface includes an angled section. A drive member is axially spaced from the tool member. The drive member includes a radially outer surface portion and a radially inner surface portion. The radially outer surface portion includes an angled portion. A seal element is provided on the drive member. The seal element includes a first portion coupled to the radially outer surface portion and a second portion that is radially outwardly disengagable from the radially outer surface portion in response to one of fluid pressure and fluid flow.

In accordance with another exemplary embodiment, a method of activating a downhole tool includes transporting the downhole tool into a selected position of a wellbore, radially outwardly deflecting a seal element provided on a drive member toward an annular wall of the wellbore, urging the drive member toward the tool member, and activating the tool member with the drive member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
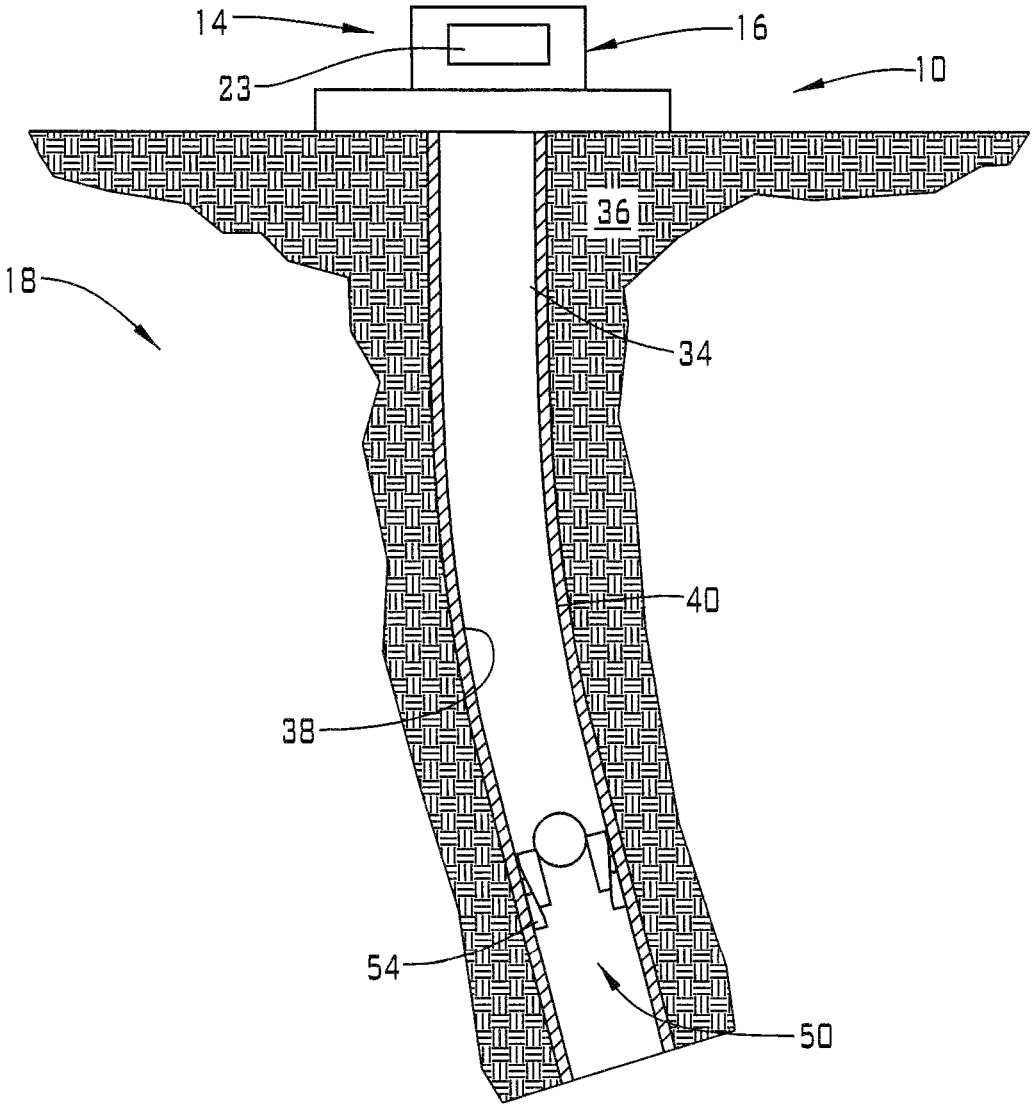
FIG. 1 depicts a resource exploration and recovery system with a downhole tool, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, stimulation, fracturing and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a wellbore 34 formed in formation 36. Wellbore 34 includes an annular wall 38 which may be defined by a surface of formation 36, or a casing tubular 40 such as shown. It should be understood, that the exemplary embodiments may also be employed in open hole systems and/or systems that may employ one or more liner hangars.

Figure 2:
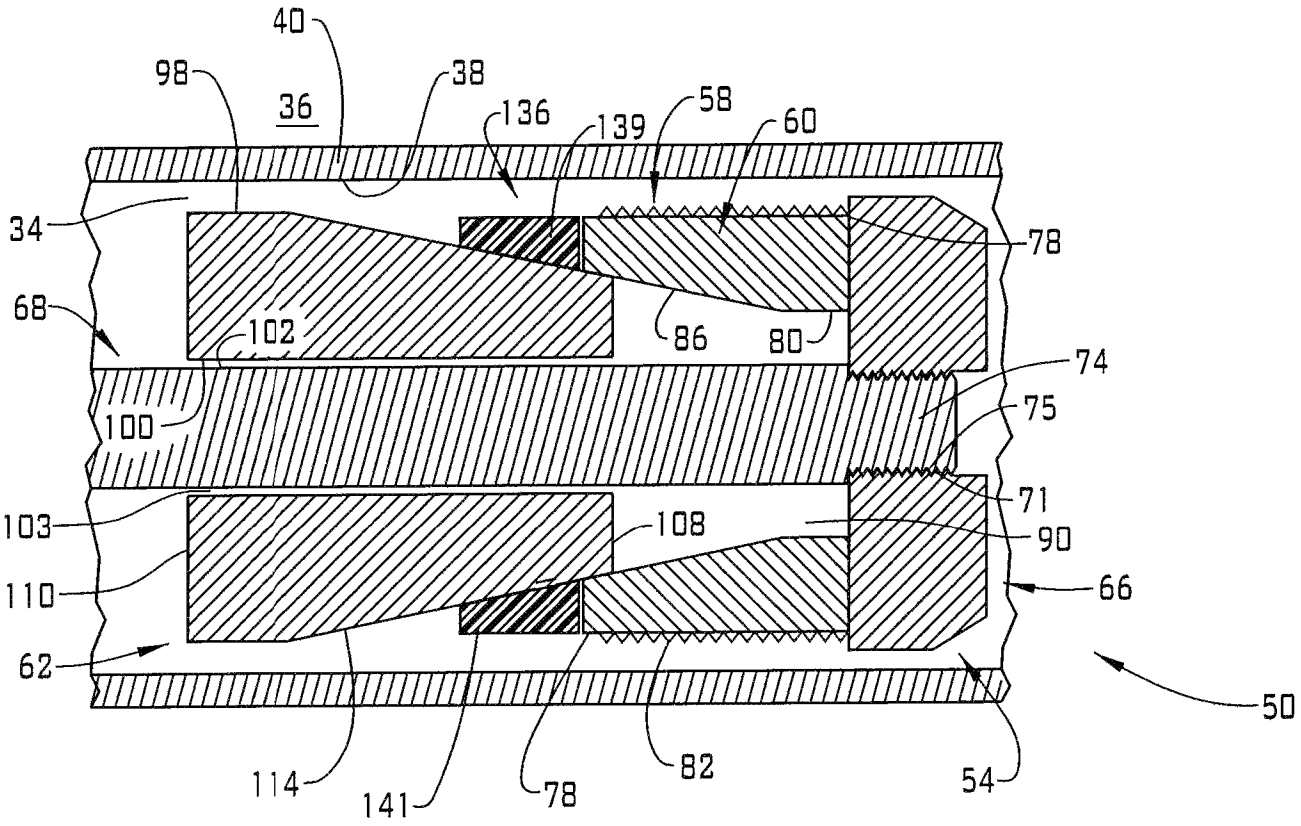
FIG. 2 depicts a cross-sectional side view of the downhole tool of FIG. 1 being deployed downhole.

In an exemplary aspect, a downhole tool 50 is arranged in casing tubular 40 and may be selectively engaged with annular wall 38. In an embodiment, downhole tool 50 may take the form of a frac plug 54. Referring to FIG. 2, frac plug 54 includes a tool member 58 that is shown in the form of an anchor such as a slip 60. A drive member 62 may be employed to urge slip 60 into engagement with annular wall 38 as will be discussed herein. Frac plug 54 may be conveyed downhole by a carrier member 66 that is transported by a carrier element 68.

Carrier member 66 includes a central opening (not separately labeled) that may be provided with a plurality of shear elements 71. Carrier element 68 includes a terminal end 74 that may include a plurality of shear members 75 that inter-engage with the plurality of shear elements 71. When in position, carrier element 68 may be disengaged from carrier member 66 through application of an upwardly directed tensile force and removed from wellbore 34. It should be understood that other mechanisms such as rotation, shear screws, release studs, and the like may be employed to disengage carrier element 68 from carrier member 66.

In an embodiment, tool member 58 includes a radially outer surface 78 and a radially inner surface 80. Radially outer surface 78 may include surface features 82 that promote engagement with casing tubular 40. Radially inner surface 80 includes an angled section 86 and defines a first passage 90 that may be receptive of carrier element 68. Angled section 86 may be engaged by drive member 62 to radially outwardly expand tool member 58 into engagement with casing tubular 40.

In further accordance with an exemplary embodiment, drive member 62 include a radially outer surface portion 98 and a radially inner surface portion 100 that defines a second passage 103 that may also be receptive of carrier element 68. Drive member 62 includes a first end 108 positioned adjacent tool member 58 and a second end 110. Radially outer surface portion 98 includes an angled portion 114 that extends from first end 108 towards second end 110.

In still further accordance with an exemplary embodiment, drive member 62 carries a seal element 136 on radially outer surface portion 98. Seal element 136 includes a first portion 139 that is secured to drive member 62 and a second portion 141 that is disengaged from drive member 62. First portion 139 may be secured to drive member 62 through a variety of mechanisms including a physical bond, friction and the like. By disengaged, it should be understood that second portion 141 may deflect radially outwardly of drive member 62 when exposed to a selected force.

In accordance with an exemplary aspect, first portion 139 of seal element 136 may include a first stiffness and second portion 141 of seal element 136 may include a second stiffness that is less than the first stiffness. In the embodiment shown, first and second portions 139 and 141 are formed from the same material. Of course, it should be understood that seal element 136 may be formed as a composite of two or more materials.

Figure 3:
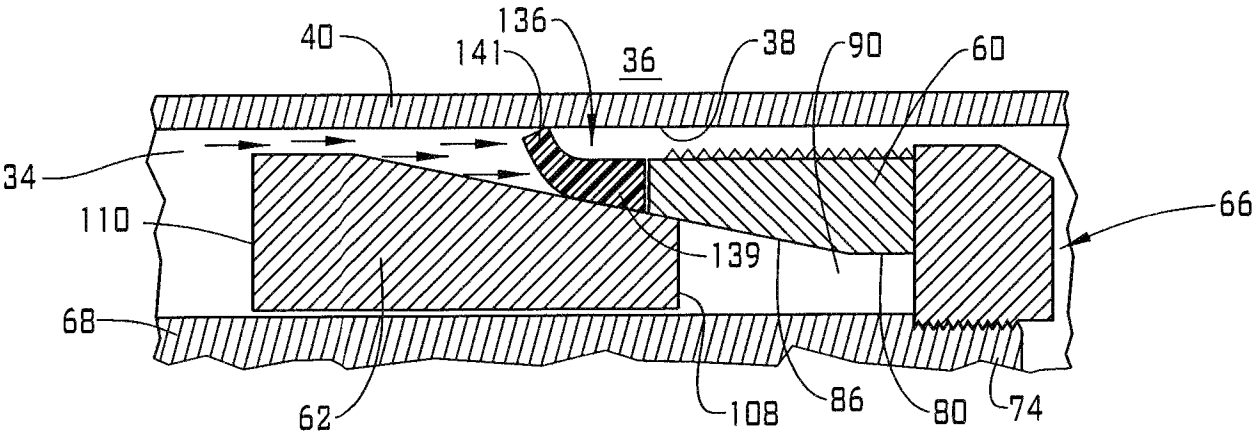
FIG. 3 depicts a fluid acting on a seal element of the downhole tool of FIG. 2, in accordance with an aspect of an exemplary embodiment.
Figure 4:
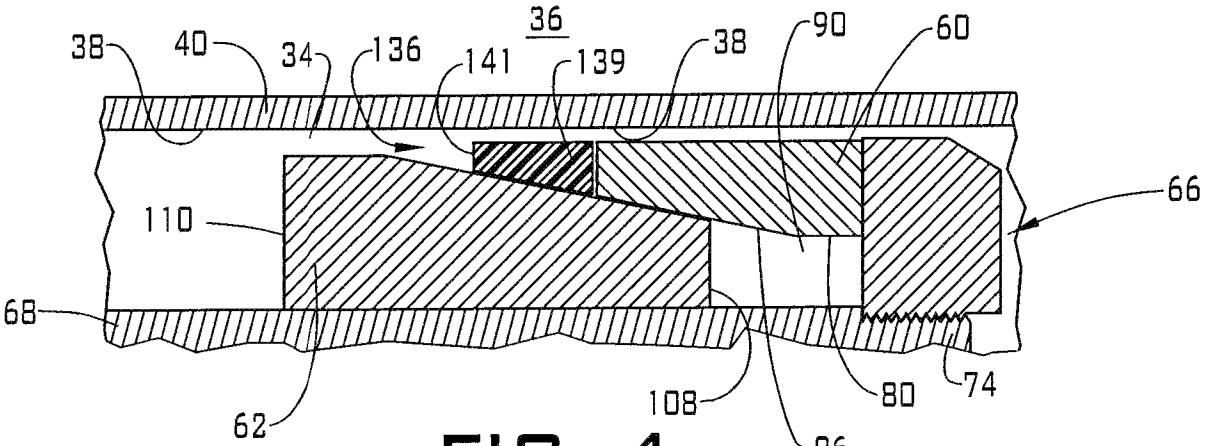
FIG. 4 depicts a partial cross-sectional side view of the downhole tool of FIG. 3 subsequent to activation, in accordance with an aspect of an exemplary embodiment.
Figure 5:
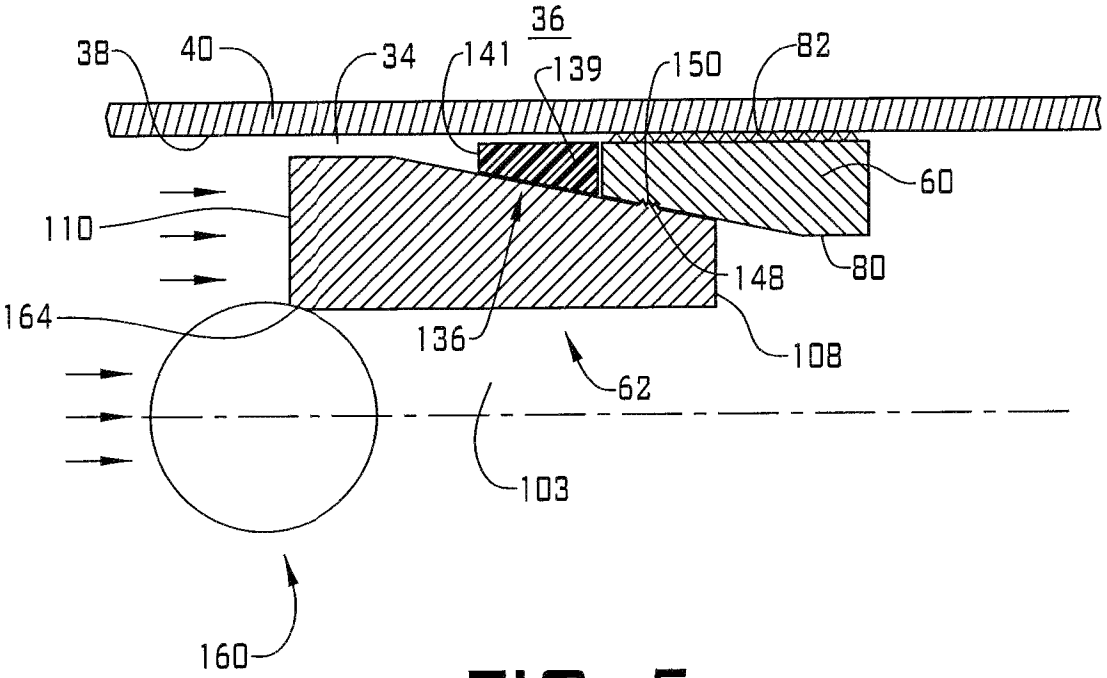
FIG. 5 depicts a drop ball sitting upon the downhole tool of FIG. 4, in accordance with an aspect of an exemplary embodiment.

Reference will now follow to FIGS. 3-5 in describing a method of setting tool member 58 in accordance with an exemplary embodiment. In an embodiment, downhole tool 50 is run downhole on carrier element 68 to a selected location along casing tubular 40. When at the selected position, fluid is introduced into casing tubular 40 from first system 14. The fluid is introduced at a selected pressure causing second portion 141 of seal element 136 to deflect radially outwardly toward inner surface 38 as shown in FIG. 3. At this point, it should be understood that the term fluid pressure also encompasses a selected fluid flow rate.

The fluid pressure may then act upon second end 110 of drive member 62. Drive member 62 released from seal element 136 and forced along or into tool member 58. More specifically, angled portion 114 acts upon angled section 86 causing tool member 58 to expand radially outwardly as shown in FIG. 4. Drive member 62 may act upon tool member 58 causing surface features 82 to "bite" into inner surface 38. It should be understood that drive member 58 may engage with annular wall through a frictional force. In an embodiment, angled section 86 may include a first set of locking members 148 and angled portion 114 may include a second set of locking members 150 that inter-engage to secure drive member 62 to tool member 58.

After drive member 62 inter-engages with tool member 58 a tensile force may be applied to carrier element 68. The tensile force, directed in an uphole direction, causes shear members 75 to dis-engage from shear elements 71 allowing carrier member 68 to be withdrawn from wellbore 34 as shown in FIG. 5. Of course, it could be understood that other mechanisms may be used to dis-engage carrier element 68 from carrier member 66. After carrier element 68 is withdrawn, a flow restricting device, such as a drop ball 160 may be introduced into wellbore 34 and allowed to pass to drive member 62.

Drive member 62 may include a flow restricting device receiver such as a ball seat 164 that is receptive of drop ball 160. At this point, fluid pressure may be introduced to wellbore 34 to create a fracture (not shown) in formation 36. It should be understood that the flow restricting device may take on various forms and the drop ball described herein is just one example. The flow restricting device may block or impede fluid flow and could take the form of a drop ball, a dart or other device introduced into wellbore 34 or the flow restricting device may be integrated into drive member 62 or other component.

At this point, it should be understood that the exemplary embodiments describes a method and system for setting a downhole tool without the need for special tools, explosive devices or the like. It should also be understood that while described in terms of a frac plug, the downhole tool may take on various forms including packers, sliding sleeves, liner hangers, and the like.

Embodiment 1: A downhole tool including: a tool member including a radially outer surface and a radially inner surface, the radially inner surface including an angled section; a drive member axially spaced from the tool member, the drive member including a radially outer surface portion and a radially inner surface portion, the radially outer surface portion including an angled portion; and a seal element provided on the drive member, the seal element including a first portion coupled to the radially outer surface portion and a second portion that is radially outwardly disengagable from the radially outer surface portion in response to one of fluid pressure and fluid flow.

Embodiment 2: The downhole tool as in any prior embodiment, wherein the drive member includes a first end engageable with the tool member and a second end axially spaced from the tool member, the angled portion extending from the first end toward the second end.

Embodiment 3: The downhole tool as in any prior embodiment, wherein the first portion of the seal element is mounted at the first end and the second portion extends toward the second end along the angled portion.

Embodiment 4: The downhole tool as in any prior embodiment, wherein the first portion of the seal element is formed from a first material having a first stiffness and the second portion of the seal element is formed from a second material having a second stiffness that is less than the first stiffness.

Embodiment 5: The downhole tool as in any prior embodiment, wherein the first material is distinct from the second material.

Embodiment 6: The downhole tool as in any prior embodiment, further including a carrier member axially spaced from the drive member, the tool member being arranged between the carrier member and the drive member.

Embodiment 7: The downhole tool as in any prior embodiment, wherein the carrier member includes a central opening having formed therein one or more shear elements.

Embodiment 8: The downhole tool as in any prior embodiment, wherein the radially inner surface defines a first passage and the radially inner surface portion defines a second passage that registers with the first passage.

Embodiment 9: The downhole tool as in any prior embodiment, further including: a carrier element extending through the first passage and the second passage, the carrier element including one or more shear members that inter-engage with the one or more shear elements.

Embodiment 10: The downhole tool as in any prior embodiment, wherein the tool member defines an anchor.

Embodiment 11: A method of activating a downhole tool including: transporting the downhole tool into a selected position of a wellbore; radially outwardly deflecting a seal element provided on a drive member toward an annular wall of the wellbore; urging the drive member toward the tool member; and activating the tool member with the drive member.

Embodiment 12: The method as in any prior embodiment, wherein activating the tool member includes radially outwardly expanding a frac plug into contact with the annular wall of the wellbore.

Embodiment 13: The method as in any prior embodiment, wherein radially outwardly deflecting the seal element includes radially outwardly deflecting a first portion of the seal element while a second portion of the seal element is fixed relative to the drive member.

Embodiment 14: The method as in any prior embodiment, wherein radially outwardly deflecting the first portion of the seal element includes radially outwardly deflecting a portion of the seal element having a stiffness that is less than a stiffness of another portion of the seal element.

Embodiment 15: The method as in any prior embodiment, wherein transporting the downhole tool into the wellbore includes shifting a carrier member connected to a carrier element into the wellbore.

Embodiment 16: The method as in any prior embodiment, further including: dis-engaging the carrier element from the carrier member after activating the downhole tool.

Embodiment 17: The method as in any prior embodiment, wherein radially outwardly deflecting the seal element includes introducing a flow of fluid having a selected flow rate into the wellbore.

Embodiment 18: The method as in any prior embodiment, further including: positioning a flow restrictor device on the drive member after activating the tool member.

Embodiment 19: The method as in any prior embodiment, wherein positioning the flow restrictor device includes guiding a drop ball toward the downhole tool.

Embodiment 20: The method as in any prior embodiment, further comprising: further activating the tool member by introducing a flow of fluid into the wellbore to act upon the flow restrictor.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole tool comprising:

a tool member including a radially outer surface and a radially inner surface, the radially inner surface including an angled section;

a drive member axially spaced from the tool member, the drive member including a radially outer surface portion and a radially inner surface portion, the radially outer surface portion including an angled portion; and a seal element provided on the drive member, the seal element including a first portion formed from a first material coupled to the radially outer surface portion and a second portion formed from a second material that is radially outwardly disengagable from the radially outer surface portion in response to one of fluid pressure and fluid flow, wherein the first material includes a first stiffness and the second material having a second stiffness that is less than the first stiffness.

2. The downhole tool according to claim 1, wherein the drive member includes a first end engageable with the tool member and a second end axially spaced from the tool member, the angled portion extending from the first end toward the second end.

3. The downhole tool according to claim 2, wherein the first portion of the seal element is mounted at the first end and the second portion extends toward the second end along the angled portion.

4. The downhole tool according to claim 1, wherein the first material is distinct from the second material.

5. The downhole tool according to claim 1, further comprising a carrier member axially spaced from the drive member, the tool member being arranged between the carrier member and the drive member.

6. The downhole tool according to claim 5, wherein the carrier member includes a central opening having formed therein one or more shear elements.

7. The downhole tool according to claim 6, wherein the radially inner surface defines a first passage and the radially inner surface portion defines a second passage that registers with the first passage.

8. The downhole tool according to claim 7, further comprising: a carrier element extending through the first passage and the second passage, the carrier element including one or more shear members that inter-engage with the one or more shear elements.

9. The downhole tool according to claim 1, wherein the tool member defines an anchor.

10. A method of activating a downhole tool including a tool member comprising:

transporting the downhole tool into a selected position of a wellbore;

radially outwardly deflecting a seal element having a first portion formed from a first material including a first stiffness and a second portions formed from a second material having second stiffness that is less than the first stiffness, the seal element being provided on a drive member toward an annular wall of the wellbore;

urging the drive member toward the tool member; and activating the tool member with the drive member.

11. The method of claim 10, wherein activating the tool member includes radially outwardly expanding a frac plug into contact with the annular wall of the wellbore.

12. The method of claim 10, wherein radially outwardly deflecting the seal element includes radially outwardly deflecting the first portion of the seal element while the second portion of the seal element is fixed relative to the drive member.

13. The method of claim 10, wherein transporting the downhole tool into the wellbore includes shifting a carrier member connected to a carrier element into the wellbore.

14. The method of claim 13, further comprising: disengaging the carrier element from the carrier member after activating the downhole tool.

15. The method of claim 10, wherein radially outwardly deflecting the seal element includes introducing a flow of fluid having a selected flow rate into the wellbore.

16. The method of claim 15, further comprising: positioning a flow restrictor device on the drive member after activating the tool member.

17. The method of claim 16, wherein positioning the flow restrictor device includes guiding a drop ball toward the downhole tool.

18. The method of claim 16, further comprising: further activating the tool member by introducing a flow of fluid into the wellbore to act upon the flow restrictor.

* * * * *